166-250 SR

2/24/81 OR 4,252,190

United States Patent [19]

Jageler et al.

[11] 4,252,190

[45] Feb. 24, 1981

[54] WIRELINE STABILIZATION METHOD AND APPARATUS

[75] Inventors: Alfred H. Jageler; Theodore V. Lautzenhiser, both of Tulsa, Okla.

[73] Assignee: Standard Oil Company (Indiana), Chicago, Ill.

[21] Appl. No.: 13,958

[22] Filed: Feb. 22, 1979

[51] Int. Cl.[3] ..... B66D 1/50; E21B 47/00

[52] U.S. Cl. ..... 166/250; 166/64; 166/362; 254/270

[58] Field of Search ..... 254/172; 166/250, 254, 166/255, 362, 335

[56] References Cited

U.S. PATENT DOCUMENTS

| | | | |
|---|---|---|---|
| 3,001,396 | 9/1961 | Cleveland | 254/172 UX |
| 3,276,746 | 10/1966 | Berne | 254/172 |
| 3,380,714 | 4/1968 | Martin | 254/172 |
| 3,462,125 | 8/1969 | Gollwitzer et al. | 254/172 |
| 3,650,323 | 3/1972 | Kanady | 254/172 X |

*Primary Examiner*—Stephen J. Novosad

*Attorney, Agent, or Firm*—James H. Dautremont

[57] ABSTRACT

Downhole variations in wireline cable tension are substantially reduced for offshore exploration by means of an auxiliary cable tensioning system preferably installed at the ocean floor wellhead. Part of the lifting force applied to a wireline cable is provided by the wireline stabilization tool at the wellhead so that fluctuations in wireline tension above the wellhead caused by ocean disturbances on the floating platform will be effectively filtered out and isolated from the main cable downhole from the wellhead. This downhole isolation is achieved with a moving wireline as well as with a stationary cable.

9 Claims, 2 Drawing Figures

WIRELINE STABILIZATION METHOD AND APPARATUS

FIELD OF THE INVENTION

This invention relates to marine well logging and more particularly to a method and apparatus for stabilizing a downhole wireline and for providing an accurate measurement of the location of a downhole tool.

BACKGROUND OF THE INVENTION

Petroleum explorationists often find it desirable to determine detailed information about an existing well. The standard technique for obtaining information such as resistivity, porosity, and density along the entire extent of the well is to lower an appropriate "logging" tool with a control cable or "wireline" to the bottom of the well and then slowly pull the tool up the full extent of the well while making accurate measurements of the desired parameters as well as recording the progressive tool location. This "well logging" technique has been developed to a very precise art in the petroleum industry.

A critical aspect of successful well logging is the accurate measurement of the location of the downhole logging tool. The accuracy must be especially precise for certain tools such as a borehole gravity meter. The precise measurement of tool location in deep wells can be, and usually is, a delicate operation. The most significant problem encountered is the tendency for the wireline to elastically deform and stretch under its own weight and the weight of the downhole tool. It is therefore necessary to carefully control the rate of the initial acceleration and eventual steady state velocity of the wireline as it is drawn up the length of the well in order to prevent the tool from "bobbing" in the well (which could be caused by uncontrolled fluctuations in the wireline tension). Suitable techniques, which are in current use throughout the petroleum industry, have been developed to overcome the above-mentioned difficulties during the logging of land-based wells.

A new dimension is added to the wireline stabilization problem when the logging operation is conducted on an offshore well from a floating vessel. In particular, the waves and swells of the sea water can cause the logging vessel to pitch, roll, bob, and sway relative to the wellhead at the ocean floor. These undesirable motions can occur even if the offshore logging is being done from a platform connected to or raised from the ocean floor. If such motion is not in some way eliminated from the wireline near the top of the well, the downhole tool may be caused to bob in an undefined manner such that a precise measurement of the location of the tool will be impossible. Furthermore, even if the location of a downhole tool is measured to the desired degree of accuracy, the tool itself may be of the type that will produce a meaningful reading of a particular well parameter only if it is stationary in the well. With such a tool no motion of the wireline in the well is tolerable.

Compensators, similar to the Rucker drillstring compensator, are available which can be used to substantially decrease fluctuations in wireline tension experienced while logging from an offshore rig. Unfortunately, these compensators are inadequate to sufficiently insulate the wireline from unacceptable motion under even moderately severe weather conditions. The applicants are not aware of any method or apparatus, other than the instant invention, which is capable of providing adequate wireline stabilization and logging tool location for offshore well logging operations under conditions of moderate to heavy seas.

SUMMARY OF THE INVENTION

It is therefore an object of the instant invention to substantially eliminate movement of a downhole logging tool in an offshore well due to weather conditions at the ocean surface.

It is a further object of the instant invention to provide a precise measurement of the location of a downhole logging tool in an offshore well, not withstanding the weather conditions at the ocean surface.

Yet a further object of the instant invention is to provide means for maintaining a substantially constant tension on a downhole wireline used for logging of off-shore wells.

These and other objects will become more readily understood and apparent upon inspection of the drawing and a reading of the following brief description of the drawing and detailed description of the preferred embodiment.

DETAILED DESCRIPTION OF THE PREFERRED EMBODIMENT

Figure 1:
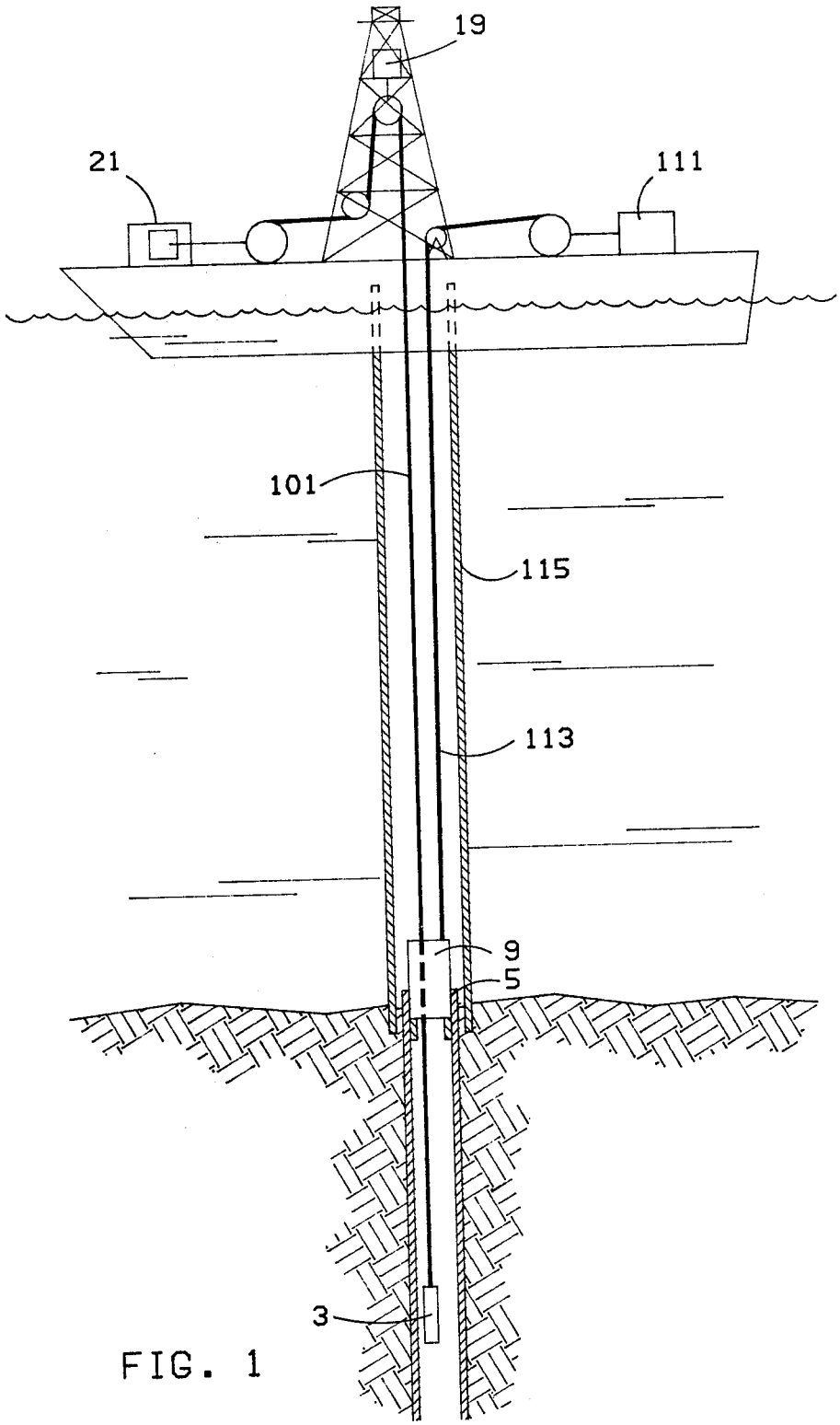
FIG. 1 shows a typical application of the instant invention for wireline stabilization in offshore well logging.

Referring now to FIG. 1, depicted therein is a typical example of an application of the instant invention for performing well logging of an offshore well. Therein the wireline logging cable 101 supports a downhole logging tool 3. The wireline cable 101 is partially supported at the wellhead 5 near the ocean floor 7 by the stationary Wireline Stabilization Tool (WST) 9 which in turn is connected to the WST control panel 111 via WST control cable 113. The cables 101 and 113 are enclosed within riser pipe 115 which extends upwardly to the offshore drilling rig 17. Wireline 101 extends around the wave compensator 19 to the wireline logging reel 21. The WST 9 applies a lifting force (determined and monitored by an operator at the WST control panel 111) to the wireline cable 101 as the cable moves up out of the well. The lifting force provided by the WST is only a fraction of the total force required to support and lift the wireline 101 and the logging tool 3, but it is greater than the variations in wireline tension not removed by the wave compensator 19. The major part of the force for lifting the wireline and the logging tool is normally provided by the main logging reel 21. Thus, as the wireline is being pulled up the well, as well as when the wireline is stationary, the force necessary to support the wireline and the logging tool within the wall is supplied by the combined effect of the WST 9 and the wireline logging reel 21. With this arrangement, the small fluctuations in tension that are not eliminated by the compensator 19 will be removed from the downhole wireline by the action of the WST. The downhole logging tool 3 is thus completely insulated from disturbing effects caused by weather and wave motion at the ocean surface.

Figure 2:
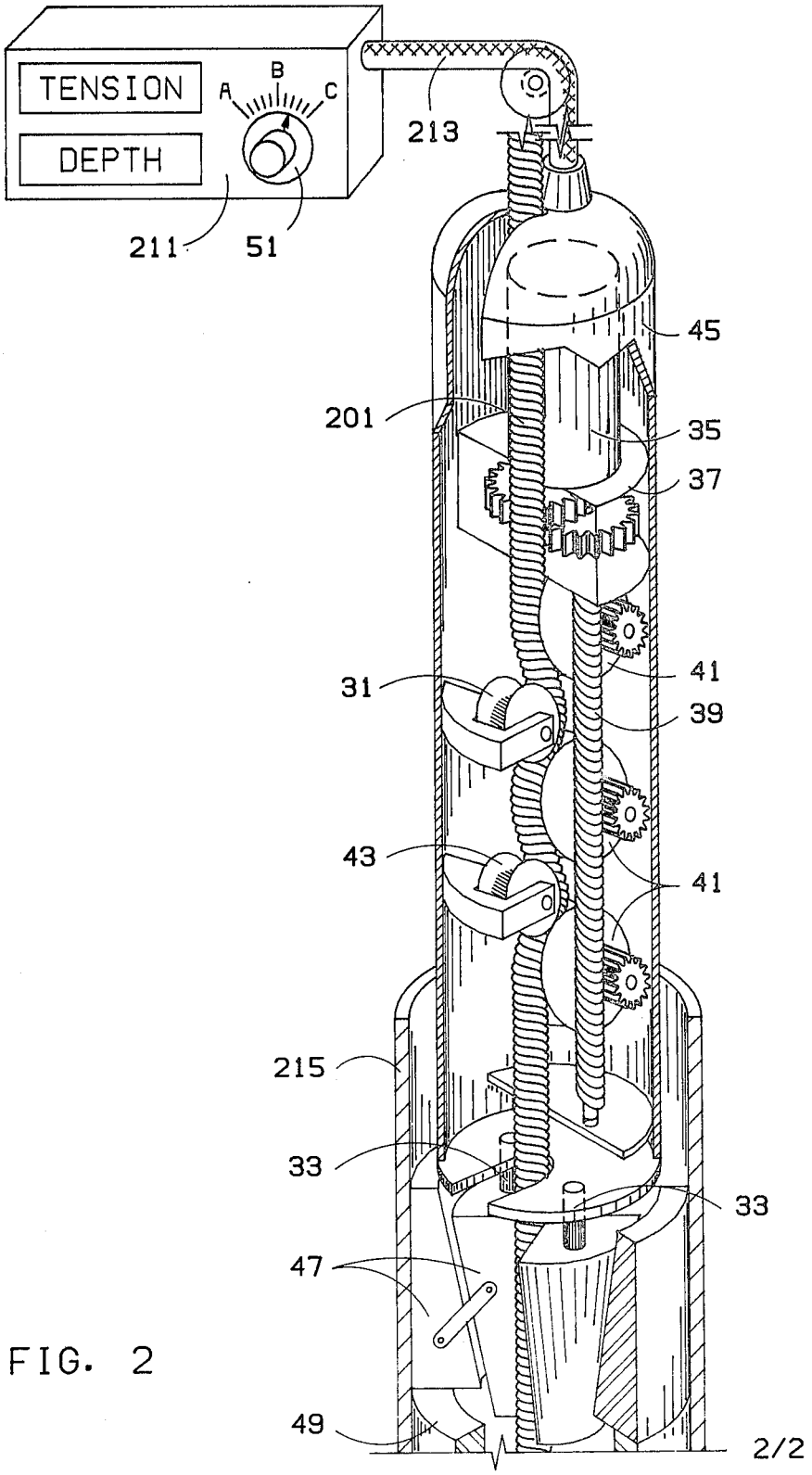
FIG. 2 depicts specific details of the preferred apparatus of the instant invention.

Turning now to FIG. 2, therein depicted are the mechanical details of the preferred embodiment of the wire stabilization tool. The WST control panel 211 includes digital readout displays of both wireline depth as indicated by depth selsyn wheel 31 and the lifting tension supplied by the WST to the wireline logging cable 201, said tension being monitored by strain gauge 33. The strain gauge signal and the depth selsyn wheel signal as well as the control signal and power for the motor 35 are transmitted between the WST and the WST control panel via the WST control cable 213. The WST control panel 211 includes a control knob 51 which is used to control the direction and torque of the motor 35. Thus, with the control knob 51 pointing to B, the motor 35 will be unenergized. As the knob 51 is moved closer to A, a stronger and stronger counterclockwise torque is applied by the motor 35 to the reducing gear box 37. In a like manner, moving the knob 51 from position B towards position C results in a clockwise torque being applied by the motor 35 to the reducing gear box 37. Reducing gear box 37 in turn supplies a corresponding torque via worm 39 to worm wheels 41. These worm wheels 41 work in conjunction with depth selsyn wheel 31 and idler wheel 43 to grip the wireline logging cable 201 ad apply a continuously variable lifting tension thereto. The amount of lifting tension applied to the wireline 201 is controlled by the operator by adjusting knob 51. It is to be clearly understood that the WST is intended as a specialty tool for applying a lifting force on the wireline 201. This lifting force is controlled via the motor control knob 51 as described above, and the lifting force is maintained by the tool operator at a level greater than the expected wireline tension variations allowed by compensator 19. An alternative approach would be to have an automatic control system adjust and maintain the tension applied by the WST. With such a system the control signal could be the output voltage of strain gauge 33.

The entire WST is enclosed by housing 45 and supported in the riser piper 215 by means of a standard clamping slip mechanism 47. As depicted in FIG. 2, the clamping slip mechanism 47 is connected to the WST housing 45 only by means of the strain gauges 33. Thus, any relative compressional force between the clamping slip mechanism 47 and the WST housing 45 is directly sensed by the strain gauges 33. That compressional force will be the same value as the lifting force exerted by the WST on the wireline logging cable 201, since the WST and the clamping slips are stationary and by Newton's law of statics the sum of the forces on a stationary body must be equal to zero. This slip mechanism may include solenoid controlled magnetic contact plates for magnetically clamping to a well pipe at a desired well location. An alternative support mechanism would comprise an annular mounting ring designed to fit within riser pipe 215 and sit on intermediate pipe hanger 49. As depicted in FIG. 2, the WST is capable of gripping the wireline logging cable 201 and applying an upward tension thereon both while the cable is concurrently being moved upwards by the logging reel 21 and when the logging reel is stationary.

It is to be understood that the instant invention is not limited to the specific details of the preferred embodiment described above (for example, the particular worm gear drive mechanism disclosed), but rather is limited only by the scope of the appended claims.

What is claimed is:

1. A wireline stabilization tool for eliminating variations in tension from a wireline in a well, comprising:

means for gripping said wireline and for applying a lifting force to said wireline;

means for measuring said lifting force applied;

means for controlling said lifting force applied; and, means for statically connecting said wireline stabilization tool to said well.

2. A wireline stabilization tool according to claim 1, further comprising means for measuring the depth of extension of said wireline into said well below the location of said wireline stabilization tool.

3. The tool of claim 2 wherein said measuring means comprises a selsyn wheel which is rotated by said wireline as said wireline moves through said tool.

4. The wireline stabilization tool of claim 1 wherein said gripping means includes movable means for applying said lifting force to said wireline when said wireline is moving in said well.

5. The tool of claim 1 wherein said lifting force measuring means comprises a strain gauge connected between said tool and said static well connecting means.

6. The tool of claim 1 wherein said static well connecting means comprise slips for gripping the inside of said well.

7. A method for stabilizing a wireline in a well, comprising the steps of:

gripping said wireline and applying a lifting force thereto at a fixed well position above where wireline stabilization is needed;

measuring said lifting force applied;

controlling said lifting force applied so that said lifting force is greater than the variations in tension in said wireline above said fixed well position.

8. The method of claim 7 including the step of measuring the length of wireline extending below said fixed well position.

9. The method of claim 7 including the step of moving said wireline in said well while said stabilization is being accomplished.

* * * * *